United States Patent [19]

Gareis

[11] 4,012,630

[45] Mar. 15, 1977

[54] LIGHTING FITTING

[76] Inventor: Richard Gareis, Ziegetsdorferstrasse, D-8400 Regensburg, Germany

[22] Filed: Feb. 12, 1975

[21] Appl. No.: 549,154

[30] Foreign Application Priority Data

June 5, 1974 Germany ..... 2427182

[52] U.S. Cl. ..... 240/10 R; 240/2 LF

[51] Int. Cl.[2] ..... A47G 33/16; F21P 1/02

[58] Field of Search ..... 240/10 R, 10 S, 10 D, 240/10 LP, 1 LP, 1 EL, 78 R, 78 F, 78 LD, 2 LF; 40/106.21, 130 R, 130 K

[56] References Cited

UNITED STATES PATENTS

| | | | |
|---|---|---|---|
| 1,351,562 | 8/1920 | Foster | 40/130 K |
| 2,225,151 | 12/1940 | Borba | 240/1 EL |
| 2,244,101 | 6/1941 | Dittman et al. | 240/10 S |
| 2,480,178 | 8/1949 | Zinberg | 40/130 K |
| 3,018,362 | 1/1962 | Joyce | 240/10 R |
| 3,043,038 | 7/1962 | Marble | 40/130 K |

FOREIGN PATENTS OR APPLICATIONS

| | | | |
|---|---|---|---|
| 1,032,053 | 3/1953 | France | 240/1 EL |

OTHER PUBLICATIONS

"Piping Light with Acrylic Materials," by Henry Pearson, Modern Plastics, Aug. 1946, pp. 123–127.

*Primary Examiner*—John Gonzales
*Attorney, Agent, or Firm*—David Fink

[57] ABSTRACT

The invention refers to a lighting fitting or unit being made from transparent material, for example from glass or from transparent plastic material, to which fitting the light energy of a light source is supplied and which fitting has several light distributing elements radiating the light energy into the room. In accordance with the invention at least one cavity or recess is provided within the light fitting, said cavity forming reflection surfaces reflecting the light energy (supplied by only one light source) to the light distributing elements, with the light fitting being preferably completely transparent and as clear as glass.

27 Claims, 9 Drawing Figures

LIGHTING FITTING

The present invention refers to a lighting fitting, especially for illumination of enclosed rooms.

A large number of different models of lighting fittings are known and, as a rule, they consist of one or more incandescent or gas discharge lamps, which are arranged under screen shades or other lamp elements especially in the case of lighting fittings used for dwelling rooms, in order to reduce the blinding glare effect of the lamps. Furthermore lighting fittings for dwelling rooms or room lighting fittings are known to exist in which the radiated light energy is distributed between a large number of small lamps each of which has relatively low power in order to achieve an especially aesthetic appearance as well as to avoid the effect of glare. Such lamps, however, are relatively expensive in their construction especially owing to the large number of necessary connections for the lamps.

All these lighting fittings have a common feature i.e., the lamp shades, glass bowls or similar devices, which enclose the light source, receive radiated light directly from the light source or light sources and the light is correspondingly diffused or scattered and in the case of coloured lamp units, coloured light is projected into the room.

The purpose of the present invention is to create a completely novel lighting fitting which is simple to produce in any required version and which, moreover, requires only a single light source and hence, in spite of a high illuminating power flux, produces either a neutral or even any desired multicolour and almost glare-free light without using, for example, light diffusing bodies, as well as coloured lamp shades and similar devices.

In order to solve this problem a lighting fitting according to the invention is characterised by at least two light conducting bodies, in which the light energy of a light source is supplied to the first of these bodies which is used as a light conductor and a beam of light is formed within this body and this light is conducted to a distributing element, which has a first reflecting surface and which forms a beam of light from at least some of the light energy and conducts it to a second body which acts as a conductor of light; hence the distributing element consists of a body which is transparent to the light and it incorporates the cavity which forms the first reflecting surfaces.

The "light conducting bodies", within the meaning of the present invention are understood to be elements which are formed preferably as rods or circular elements; these are made from material which is transparent to light and which, owing to their dimensions, are suitable for conducting light which is received at one end of such an element by total internal reflection on the longitudinal sides of the element to the other end and for radiating the light there.

A special feature of the lighting fitting according to the invention is especially that this lighting fitting is completely transparent and as clear as glass and that in particular a power supply conductor or power supply by a cable or by a similar device to the lighting fitting and to the elements which radiate light outwards is also eliminated, so that the result is a lamp effect with completely novel effects. Hence for example the lighting fitting according to the invention creates the impression that a large number of light radiating elements are provided with a special incandescent bulb, while in actuality the whole light energy is supplied to the transparent and glass clear lighting fitting by only one single light source. In this case the light fitting can be operated equally well with neutral as well as with any mutlicoloured light source, without having to resort to even the slightest modification of the glass clear form of the lighting fitting, in which, moreover, there is a possibility for the user to adjust the colour of the radiated light by a simple action to suit particular wishes. The present invention is described below in greater detail in conjunction with the figures for a model example.

The FIGS. show:

FIG. 4*a* shows a longitudinal section through another version of the lighting fitting according to the invention, which consists of a large number of series arranged distributing elements.

FIG. 4*b* shows a section along the line IV — IV of FIG. 4*a;*

Figure 5:
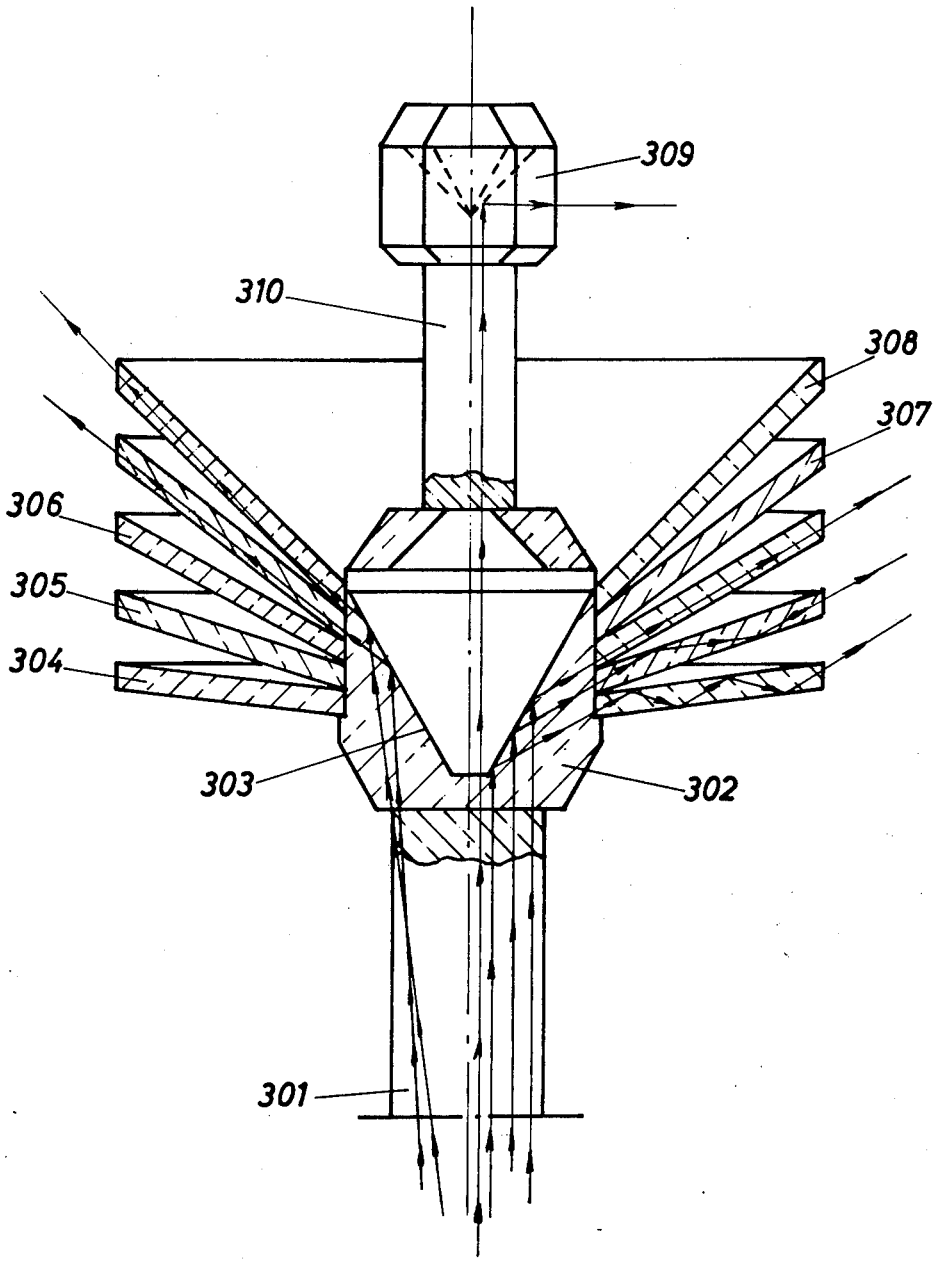

FIG. 5 shows a side view of a further model of the lighting fitting according to the invention, in part section.

Figure 6:
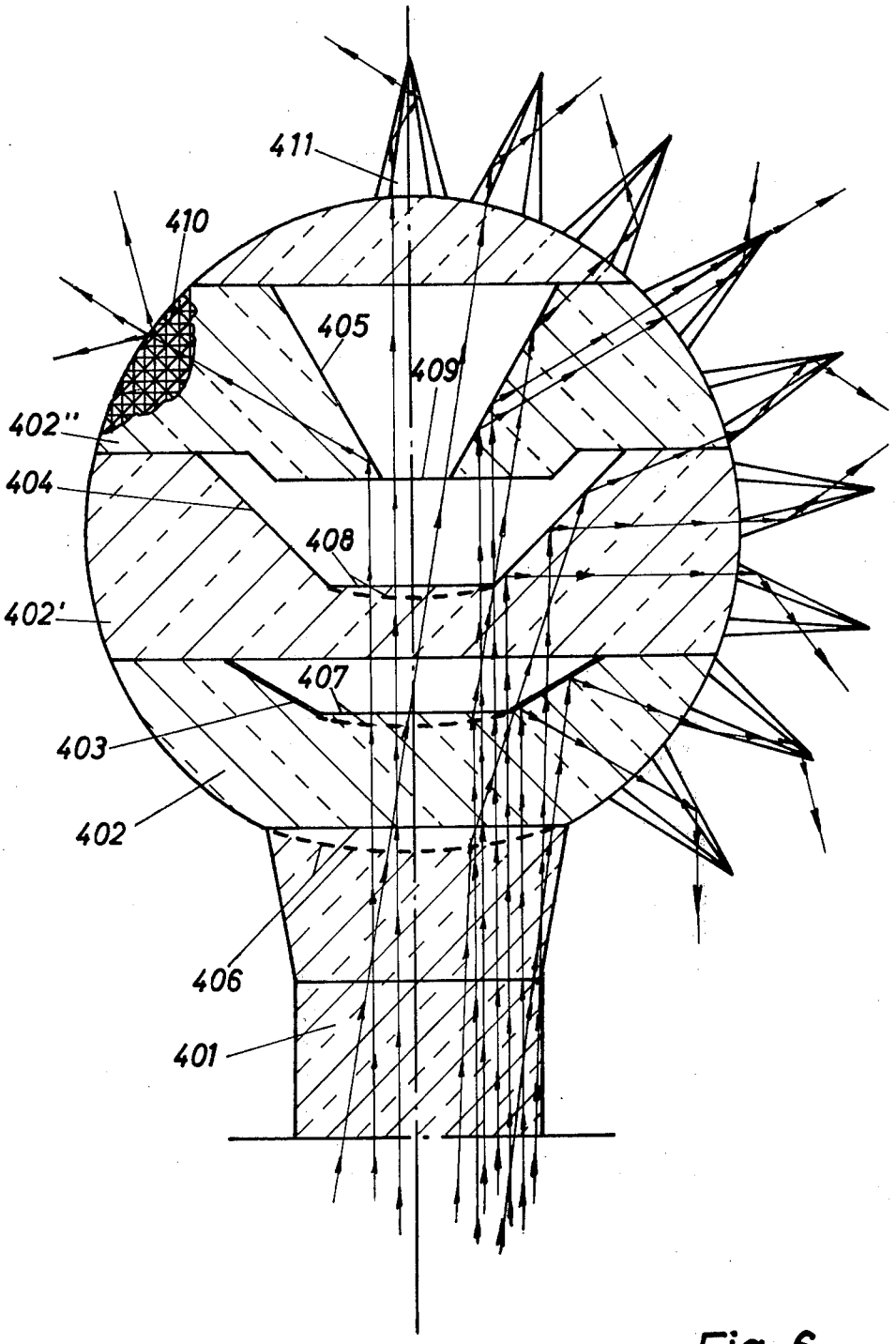
Figure 7:
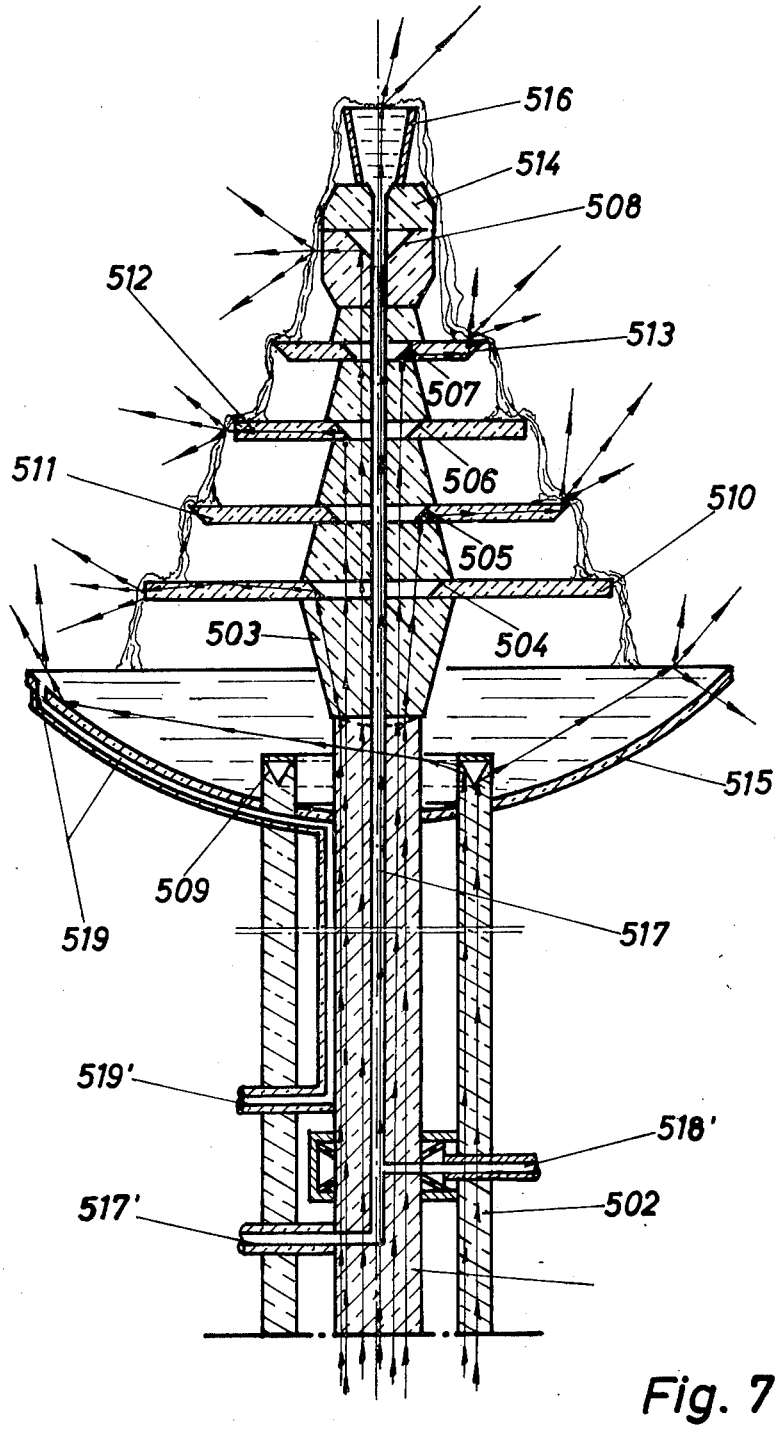
Figure 8:
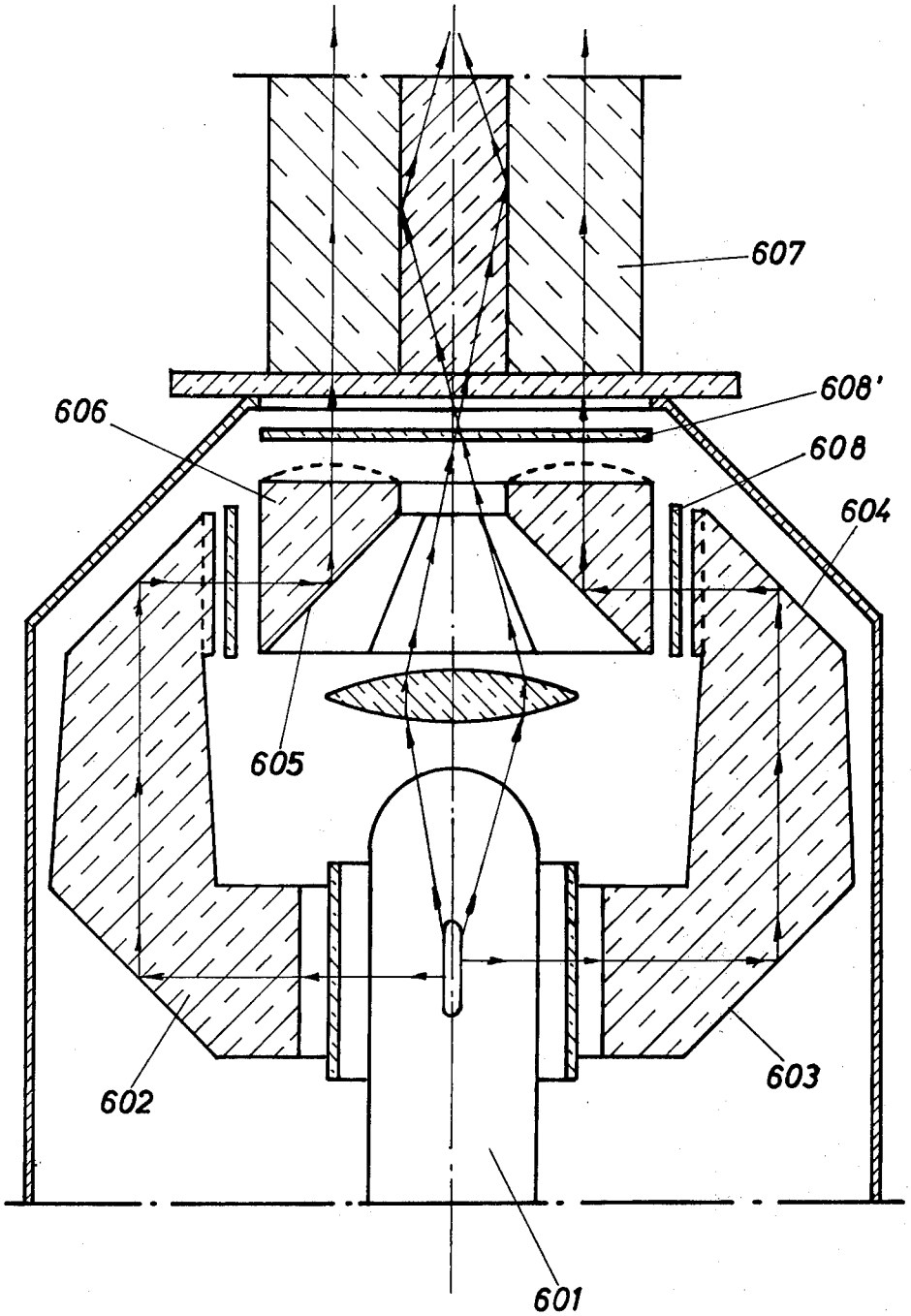

FIG. 6 shows a section through a spherical lighting fitting according to the present invention;

FIG. 7 shows a section through a lighting fitting according to the invention which is formed as a cascade fountain;

FIG. 8 shows an arrangement for concentrating the light for use in a lighting fitting according to the present invention.

Figure 1:
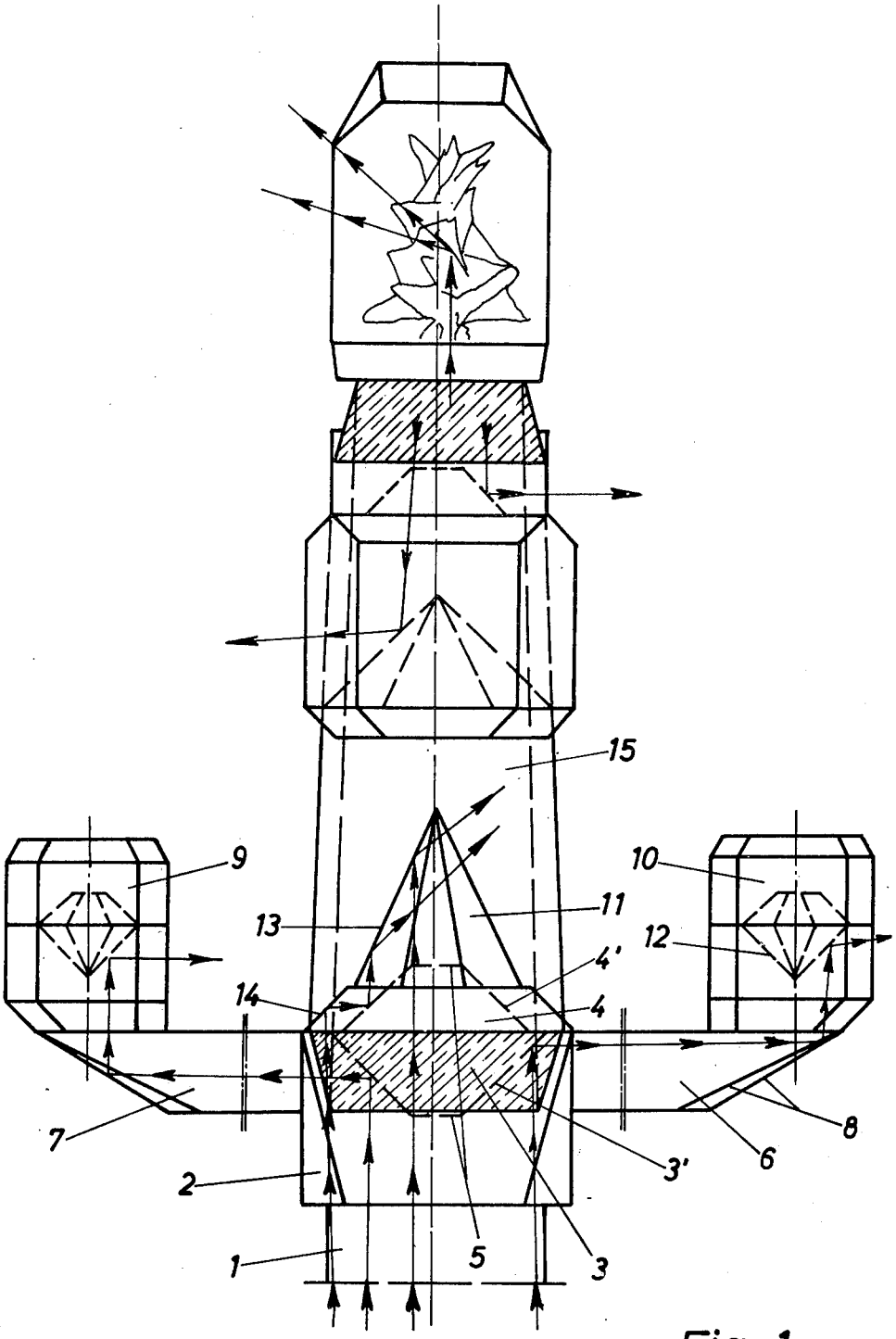
FIGS. 1 and 2 show different side views of a first embodiment of the lighting fitting in accordance with the invention, in part section.
Figure 2:
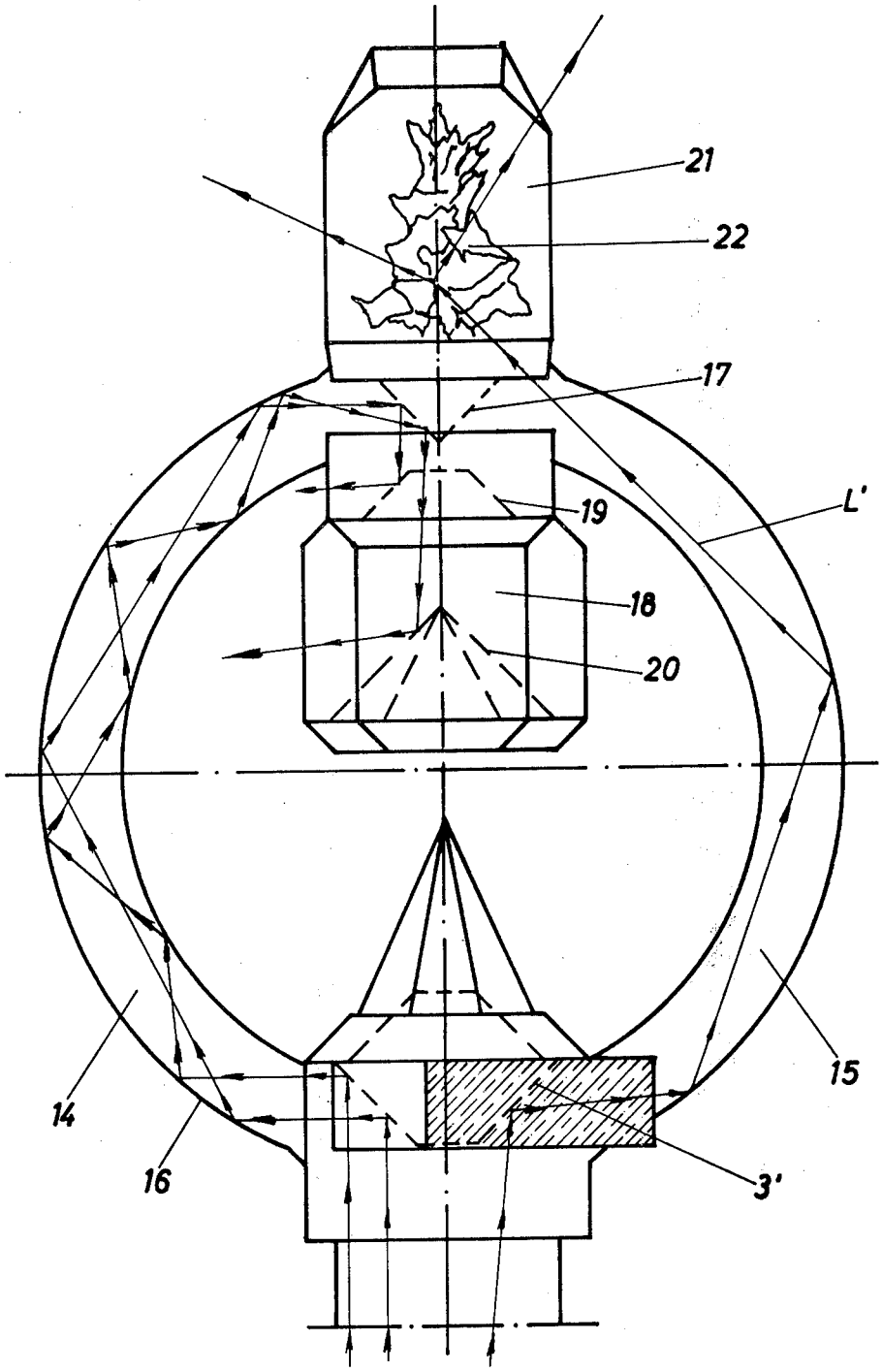

FIGS. 1 and 2 show a lighting fitting viewed from two directions which are at right angles to each other i.e. at 90°, in which the light is supplied from a light source which is not described in greater detail by means of a rod shaped light conducting body 1 of a distributing element or by the light distributing head 2, as indicated by the line L which indicates the paths of the light beams. The distributing element consists of a lower part 2' and of an upper part 2'', in which there are fitted into the upper and into the lower part, tetragonal truncated pyramid shaped hollow bodies 3 or 4, in which the reflecting surfaces 3' deflect at least some of the vertically incident light by total internal reflection horizontally into the rod type or circular light conducting bodies 6, 7, 14 and 15 which are provided around the distributing element 2. A comparison of FIGS. 1 and 2 indicates that the rod shaped light conducting bodies 6 and 7 as well as the arcuate light conducting bodies 14 and 15, which are joined to form an enclosed ring, are arranged on the distributing element 2 at 90° to each other.

Since, as a rule, light is available for the lighting fitting only from the diffusely radiating lighting sources, an appreciable proportion of the light is therefore not supplied in parallel with the distributing element 2. In order to utilise the diffused light for the lighting fitting efficiently the upper part 2'' of the distributor element is built up from a truncated pyramid shaped body with a mounted pyramid, so that the upper part of the distributing element then has external reflecting surfaces 14 as well as the internal reflecting surfaces 4' which enclose the hollow cavity 4. The diffused light or the scattered light radiation on the reflecting surfaces 14 in this case is deflected approximately horizontally to the reflecting surfaces 4' and it is conducted further from these once again at an angle or at right angles upwards into the lighting fitting element 11 which is formed by the mounted pyramid. The hollow cavity 3, 4 which is provided in the distributing element 2 has an upper as well as a lower flat surface 5; these surfaces are arranged at a distance from each other, and they are at right angles to the direction of the light or the light beam which is supplied via the light conducting body 1 and they are connected to each other by means of the reflecting surfaces 3' and 4' which are at an angle to this light beam. Depending on the area these plane surfaces 5 make it possible to conduct a specified proportion of the light, which has been supplied via the light conducting body 1, directly to the lighting fitting element 11, which then radiates diffusely into the room the light which has been reflected on the reflecting surfaces 13 by multiple reflection. The light which has been supplied to the rod shaped light conducting bodies 6 and 7 first of all reaches the reflecting surfaces 8 at the end of these bodies and from there it is reflected upwards against the projections or lighting fitting elements 9 or 10, where this reflected light impinges on the hollow cavities with reflecting surfaces 12 which are provided within projections 9 and 10 and the light is then radiated into the room.

The light which is radiated from the distributing element 2 to the arcuate light conducting elements 14 and 15 is conducted within these arcuate bodies which act once again as conductors of light, by total internal reflection to that side of the ring, formed by the bodies 14 and 15, which is opposite to the distributing element, and this ring accommodates the reflecting surfaces 17. On these reflecting surfaces 17 the light is then deflected downwards into the lighting fitting element 18, in which once again hollow bodies 19 or 20 are accommodated whose surfaces act as reflecting surfaces and which radiate the light by multiple reflection into the room. The body designated by 21 now becomes effective as a further lighting fitting element due to scattering radiation or due to reflection. Special effects are conferred on the lighting fitting by this lighting fitting element 21.

The lighting fitting element 21 is produced by the action of forces which act on a transparent, for example, thermoplastic material block in such a manner that cracks 22 are produced. A subsequent-tempering then prevents a subsequent crack propagation outwards, so that the lighting fitting element 21 has a smooth crack-free outside surface. The cracks arranged within the lighting fitting element 21 are then used as reflection surfaces and they radiate the light L, which is not collected by the reflecting surfaces 17, into the room in a diffused manner.

Figure 3:
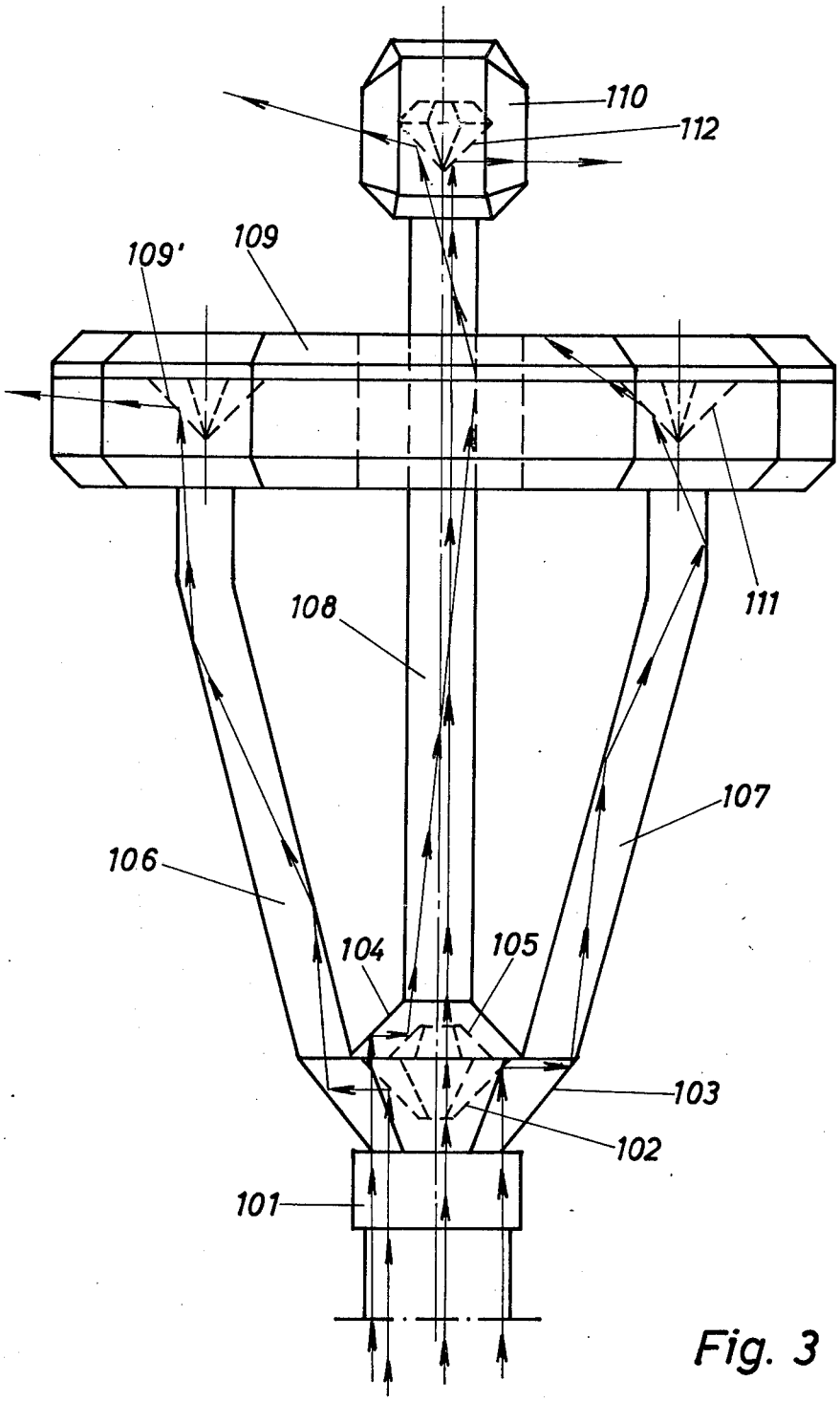
FIG. 3 shows a side view of another embodiment of the lighting fitting according to the invention, in part section.

FIG. 3 shows a further model of the lighting fitting according to the invention. This version differs from the lighting fittings according to FIGS. 1 and 2 not only in the shape of the distributing element, but also in other respects where forming is concerned. The light L is once again supplied vertically from below via the light conducting body 101 to the distributing element 102. Instead of the tetragonal truncated pyramid shaped hollow bodies in the models according to FIGS. 1 and 2, octagonal truncated pyramid shaped hollow bodies 102' and 105 are used, in the model indicated in FIG. 3, in both parts of the distributing element 102; these pyramid shaped hollow bodies divide the light supplied via the light conducting bodies 101 as well as the light supplied via the reflecting surfaces 104 and they supply light to the rod shaped light conducting bodies 108 which are arranged vertically in the direction of the incidence of light L as well as via the reflecting surfaces 103 to the rod shaped light conducting bodies 106 and 107, which are arranged at an angle to the incident light on the distributing element 102. The angle of the reflecting surfaces 103 can be selected at all times in such a manner that it is possible to achieve an optimum light supply to the rod shaped light conducting bodies 106 and 107 at any required inclination of these light conducting bodies 106 and 107 by total internal reflection. In a preferred version eight light conducting bodies 106 or 107 are arranged on the circumference of the preferably octagonal distributing element 102.

The upper end of the light conducting bodies 106 and 107 joins into a circular lighting fitting element 109, which consists also of a material which is transparent to the light, for example, perspex or acrylic plastics, glass or a similar material. Light reflecting hollow cavities 109' are accommodated, moulded or pressed into the circular body 109 above the upper ends of the light conducting bodies 106 and 107. The light energy supplied by the light conducting bodies 106 and 107 etc. will be radiated outwards from these reflecting hollow cavities 109'.

The middle part of the light beam which is conducted along the light conducting body 101 reaches the central rod shaped light conducting body 108 without reflection and it travels from there into the lighting fitting element 110, into which a hollow cavity 112, which reflects the light outwards, is once again arranged.

Figure 4:
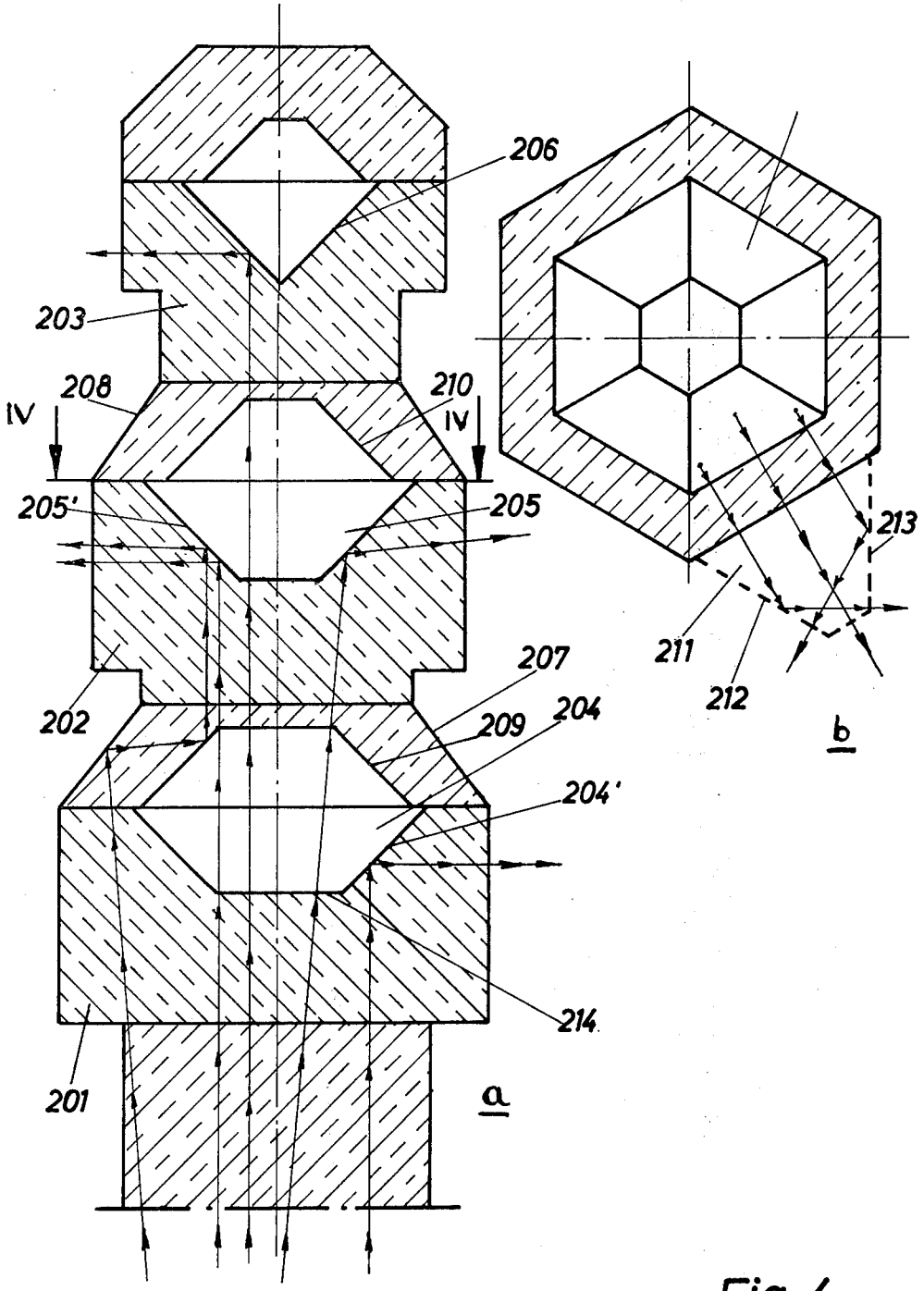

FIG. 4 shows a lighting fitting which consists of a number of distributing elements which are arranged in series in the direction of the incident light L. Since this lighting fitting is built up of identical elements in the form of cascades or of steps, it is therefore designated as a "stacked lighting fitting".

As already mentioned this stacked lighting fitting is basically only a superposed arrangement of a large number of already described distributing elements 201, in which the plane surfaces 214, 215 etc. of hollow cavities 204 or 205 have cross sections which are dimensioned in such a manner that each step is supplied by an approximately equal proportion of the light energy.

The diffused incident light on the reflecting surfaces 207 and 208 is guided by these surfaces to the reflecting surfaces 209 and 210, it is guided from here to the reflecting surfaces 205' and 206' and it is reflected outwards from these surfaces. This geometry ensures the most uniform possible radiating intensity of the reflecting surfaces 204, 205' and 206. By means of moulded or fitted prisms 211, whose surfaces form preferably an enclosed angle of 60°, the light is reflected in twice as many directions so that the reflecting occurs on the reflection surfaces 212 and 213, by means of which an effective light distribution is achieved.

If the diffused light is to be radiated practically completely in the horizontal direction in the distributing element 2 of FIG. 1, then this can be achieved by reflecting on the surfaces 3' which have a reflecting coating. Similarly it is possible to achieve additional reflection of the reflecting surfaces 103 in the model according to FIG. 3, so that light losses do not occur on these reflecting surfaces.

FIG. 5 shows a further possible model for a stacked lighting fitting. The stacked lighting fitting consists once again basically of a light distributing element 302 which has preferably a cylindrical outline shape within which a number of disc or funnel shaped light conducting bodies 304, 305, 306, 307 and 308 are arranged, on this distributing element 302, concentrically to the incident light beam L. In this version also the light energy is again supplied by a rod shaped light conducting body 301 to the distributing element 302. The light energy entering the distributing element 302 is reflected further on the reflecting surfaces 303 of the hollow cavity, provided in this distributing element, by total internal reflection to the disc or funnel shaped light conducting bodies 304, 305, 306, 307 and 308, which are connected to the distributing element 302, preferably by total internal reflection, and light is radiated into the room by their ends. The inclination of the reflecting surface 303 of the hollow cavity is in this case selected in such a manner that the light energy reflecting from it is approximately uniformly radiated and distributed on the stacked disc or funnel elements. Depending on the arrangement or on the number of the discs and funnel elements 304, 305, 306, 307, 308 the light can be radiated from the horizontal direction up to the vertical direction. In this model a light conducting body 301 which is arranged in the direction of the incident light is again provided on the distributing element 302; this light conducting body 301 carries at its end a lighting fitting element 309 with a hollow body for radiating the light into the room. In this model the hollow cavity which forms the reflecting surfaces 303 has a truncated conical shape.

Another version of the lighting fitting according to the invention is shown in FIG. 6, in which this lighting fitting has special properties; it radiates the light energy supplied to it approximately spherically and symmetrically into the room. This lighting fitting also consists basically once again of a number of distributing elements 402, 402' and 402' which are arranged in series in the direction of the incident light; these distributing elements have hollow cavities and in the model example shown in FIG. 6 their outside surfaces form a sphere. The inclined surfaces 403, 404 and 405 of the hollow cavities once again form reflecting surfaces for the light beam supplied via the light conducting body 1, in which it is ensured by the different areas of the plane surfaces 407, 408 and 409 of the hollow cavities that the outside edge of the incident light beam is reflected by the reflecting surfaces 403 which are preferably coated with reflective material and the further inwards positioned part of the incident light beam is reflected by the reflecting surfaces 404 and 405 to the outside circumference of the conical lighting fitting, while the middle part of the light beam penetrates the hollow cavity without reflecting and it emerges on the upper end of the conical lighting fitting. The surfaces 406, 407 and 408 can be curved in order to improve light distribution so that the effect of a divergent lens is obtained. The outside surface of the spherical lighting fitting is roughened either by impressed projections and depressions, as shown in 410, or pyramid shaped projections 411 are provided on these outside surfaces. The angle of inclination of the reflecting surfaces 403, 404, 405 of the hollow cavities in this case is selected in such a manner that with increasing distance from the light conducting body 1 these reflecting surfaces enclose every time a greater angle with the direction of the light beam which is supplied via the light conducting body 1, i.e., the angle of the reflecting surfaces 403 in relation to the incident light beam is greater than the corresponding angle of the reflecting surfaces 404 and 405, while the angle enclosed between the reflecting surfaces 404 and the direction of the incident light beam is greater than the corresponding angle of the reflecting surface 405. In this manner it is ensured that the light reflected by the reflecting surfaces 403 is directed at an angle downwards, the light reflected by the reflecting surfaces 404 is basically directed sideways and the light reflected by the reflecting surfaces 405 is basically directed at an angle upwards.

A model of the lighting fitting according to the invention which is arranged as a fountain is shown in FIG. 7. The light energy, preferably in different colours, is supplied to the stacked lighting fitting element 503, which is made from a series of distributing elements, from the rod shaped light conducting body 501 in whose centre is arranged the transparent water supply bore 517 which leads upwards to the overflow tank 516. The reflecting surfaces 504, 505, 506, 507 and 508 of the stacked lighting fitting element 503 distribute light preferably by total internal reflection and approximately uniformly in the direction of the disc shaped light conducting bodies 510, 511, 512 and 513 as well as to the outside surface of the lighting fitting element 514. The light energy which emerges from these light conducting bodies in different colours partly in a horizontal direction (510, 512, 514) and partly in a vertical direction (511, 513, and 516) passes from here through the water which flows above it or falls downwards and it is diffusely radiated into the room through the water. In spite of the water flow hardly any losses occur because the transparent pipe 517 which conducts water, as well as the water itself, have physically approximately the same light conducting properties as the light conducting body 501. The water is supplied either by means of a fixed connection 517' or by a flexible connection 518', while the water removal is carried out by means of the pipe 519 at the edge of the basin 505 as well as by means of the connection 519'; the circulation of water is promoted by means of a circulating pump which is not described in detail.

The multicolour light energy which is supplied through the tubular light conducting rod 502 is transmitted further on the reflecting surfaces 509 of this rod, preferably by total internal reflection in the direction of the basin 515 in which this light illuminates the water in the basin by a number of colours.

The special advantage which is provided by the application of the principle of the lighting fitting according to the invention in the case of the fountain shown in FIG. 7 or by means of similar light and water play, lies in the complete absence of danger. Since the light source and hence also the power supply for this light source are absolutely separated from the light and water system there is no possibility that persons could come into contact with the current supply either directly or indirectly via current conducting components.

In order to achieve a good yield of light it is useful to supply the light energy, which is radiated by a light source, to the lighting fitting according to the invention or to the distributing element of this lighting fitting in concentrated form. An arrangement suitable for this purpose is represented in FIG. 8 in the form of a diagram. A number of rod shaped elements 602 which are made from light conducting materials which accept light emerging from this light source by their ends which are adjacent to the light source 601 and which conduct light further via reflecting surfaces 603 and 604 to the reflecting surfaces 605 of the distributing head 606 are arranged concentrically around a light source (incandescent lamp or gas discharge lamp 601.) From the reflecting surfaces 605 the light of the light source 601 reaches the rod shaped light conducting body 607 which, for example, corresponds to the light conducting body 1 of FIG. 1, 101 of FIG. 3, 301 of FIG. 5, 401 of FIG. 6 or 501 of FIG. 7. In many instances it may be desirable that the lighting fitting according to the invention radiates coloured light. For this purpose a filter arrangement 608, which consists either of a single colour filter ring or of a number of superposed different colour filter rings is arranged between the light distributing head 606 and the rod shaped light conducting bodies 602.

The light conducting bodies in the lighting fitting according to the invention are made either from glass and/or from a plastics material which is transparent to light, for example, acrylic plastics.

I claim:

1. A lighting apparatus for use with a light source, comprising in combination:

a first light conducting body operative to conduct the light from said light source by total internal reflection;

at least one distributing element being made from light conducting material and having light reflecting surfaces and being disposed to receive the light conducted by said first body; and a second light conducting body operative to conduct light by total internal reflections and disposed to receive at least a portion of the light from said distributing element and being operative for radiating the light into the surroundings, said light reflecting surfaces defining a cavity inside said distributing element and light reflecting surfaces reflecting the light by total internal reflections with substantially none of the light leaving the light conducting material of said distributing element during said reflections.

2. The apparatus as claimed in claim 1, wherein at least a portion of the light from said distributing element incident on said second body is from said reflecting surfaces.

3. The apparatus as claimed in claim 1, further comprising a third light conducting body operative to conduct light by total internal reflections and disposed to receive at least a portion of the light from said second body which has been transmitted by said reflecting surfaces.

4. The apparatus as claimed in claim 1, wherein said first body is a cylindrical bar.

5. The apparatus as claimed in claim 1, wherein said second body includes second reflecting surfaces for orientated and diffused radiation of the light.

6. The apparatus as claimed in claim 5, wherein said second reflecting surfaces are formed by inclined surfaces.

7. The apparatus as claimed in claim 5, wherein said second reflecting surfaces are defined by cracks within said second body.

8. The apparatus as claimed in claim 5, wherein said distributing element has a hollow cavity defined in it to form said reflecting surfaces and further comprises third reflecting surfaces operative to reflect at least a portion of the light into said second body.

9. The apparatus as claimed in claim 8, wherein said hollow cavity has a first plane surface, a second plane surface separated from said first plane surface and arranged at right angles to the direction of the incident light and further surfaces disposed at an angle to the direction of the incident light; said further surfaces connecting said first plane surface with said second plane surface, said first and said second plane surface being smaller than the area of the cross section of the incident light.

10. The apparatus as claimed in claim 9, wherein said first body is connected in series with said distributing element in the direction of said light from said light source.

11. The apparatus as claimed in claim 10, wherein the cross section of said second body is disposed in the direction of the incident light and corresponds to at least one of said plane surfaces of said hollow cavity.

12. The apparatus as claimed in claim 11, further comprising at least two additional light conducting bodies disposed adjacent to the incident light to said distributing element and with lateral displacement bodies and a ring made from light conducting material and disposed concentrically to said additional light conducting bodies.

13. The apparatus as claimed in claim 12, wherein said ring is connected to said cavity.

14. The apparatus as claimed in claim 10, further comprising at least one additional light conducting body disposed near said distributing element and away from the beam of the light.

15. The apparatus as claimed in claim 14, wherein said additional light conducting body has a bar shape.

16. The apparatus as claimed in claim 1, further comprising a plurality of laterally displaced rod shaped light conducting bodies disposed radially in relation to the light and adjacent to said distributing element, said rods having reflecting surfaces defined at an angle to the direction of the incident light, said rods including projections composed of light conducting material with hollow cavities.

17. The apparatus as claimed in claim 1, further comprising a ring of a light conducting material connected laterally on to said distributing element and a further distributing element defined in said ring and disposed on the opposing side of said distributing element.

18. The apparatus as claimed in claim 1, wherein there are a plurality of said distributing elements disposed in the direction of the incident light in a series, each distributing element having at least one disc shaped light conducting body disposed concentrically thereto as well as to the incident beam of light.

19. The apparatus as claimed in claim 18, wherein each of said distributing elements has a single disc shaped light conducting body.

20. The apparatus as claimed in claim 1, wherein there are a plurality of said distributing elements desposed in series in the direction of the incident light body and the outside surfaces of said distributing elements are disposed to define a sphere.

21. The apparatus as claimed in claim 20, further comprising projections defined on the outside surface of said sphere, said projections being pyramid shaped and having outside surfaces forming second reflecting surfaces.

22. The apparatus as claimed in claim 1, wherein said reflecting surfaces are formed by a hollow cavity having a pyramidal shape.

23. The apparatus as claimed in claim 1, further comprising a reflecting coating on said reflecting surfaces.

24. The apparatus as claimed in claim 1, wherein said light source supplies light of different colors to said first light conducting body.

25. The apparatus as claimed in claim 1, wherein said first light conducting body includes a plurality of individual bodies each operative to conduct light of different color.

26. The apparatus as claimed in claim 1, wherein said distributing element includes reflecting material not transparent to the light.

27. The apparatus as claimed in claim 1, wherein said reflecting surfaces are formed by a hollow cavity having a spherical shape.

* * * * *